US010808507B2

(12) United States Patent
Burke et al.

(10) Patent No.: US 10,808,507 B2
(45) Date of Patent: Oct. 20, 2020

(54) SYSTEM AND METHOD FOR FORMING METAL-TO-METAL SEAL

(71) Applicant: SCHLUMBERGER TECHNOLOGY CORPORATION, Sugar Land, TX (US)

(72) Inventors: Travis Raymond Burke, Spring, TX (US); James Hall, Spring, TX (US); Raghavendar Ranganathan, Houston, TX (US); Srihari Chebolu, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 154 days.

(21) Appl. No.: 15/775,017

(22) PCT Filed: Sep. 7, 2016

(86) PCT No.: PCT/US2016/050459

§ 371 (c)(1),
(2) Date: May 10, 2018

(87) PCT Pub. No.: WO2017/082997

PCT Pub. Date: May 18, 2017

(65) Prior Publication Data

US 2018/0347308 A1 Dec. 6, 2018

Related U.S. Application Data

(60) Provisional application No. 62/253,621, filed on Nov. 10, 2015.

(51) Int. Cl.
*E21B 43/10* (2006.01)
*E21B 33/04* (2006.01)
(Continued)

(52) U.S. Cl.
CPC ..... *E21B 43/10* (2013.01); *E21B 23/0411* (2020.05); *E21B 33/04* (2013.01);
(Continued)

(58) Field of Classification Search
CPC .. E21B 33/128; E21B 33/1212; E21B 33/129; E21B 33/1295; E21B 23/01;
(Continued)

(56) References Cited

U.S. PATENT DOCUMENTS 2,196,668 A * 4/1940 Ragan ..... E21B 33/128 166/122
4,711,326 A * 12/1987 Baugh ..... E21B 23/01 166/212

(Continued)

OTHER PUBLICATIONS

International Search Report and Written Opinion for corresponding PCT Application Serial No. PCT/US2016/050459, dated Nov. 28, 2016, 11 pages.

*Primary Examiner* — Jennifer H Gay
(74) *Attorney, Agent, or Firm* — Kelly McKinney

(57) ABSTRACT

A technique facilitates actuation and use of a liner hanger in a wide variety of environments. Depending on the application, the liner hanger may be conveyed downhole within a casing located in a wellbore. The liner hanger comprises slips which may be set against the casing by applying a pressurized fluid through a liner hanger port to a liner hanger actuator. After the slips are set, the liner hanger may be actuated to form a metal-to-metal seal which blocks further fluid flow through the port, thus isolating the port during subsequent downhole operations.

17 Claims, 7 Drawing Sheets

(51) Int. Cl.
*E21B 23/04* (2006.01)
*E21B 33/1295* (2006.01)
*E21B 33/12* (2006.01)
*E21B 33/128* (2006.01)

(52) U.S. Cl.
CPC ..... *E21B 33/0422* (2013.01); *E21B 33/128* (2013.01); *E21B 33/1212* (2013.01); *E21B 33/1295* (2013.01)

(58) Field of Classification Search
CPC ..... E21B 43/10; E21B 23/04; E21B 23/0411; E21B 33/0422
See application file for complete search history.

(56) References Cited

U.S. PATENT DOCUMENTS 5,333,692 A 8/1994 Baugh et al.
5,924,491 A 7/1999 Jordan, Jr. et al.
6,648,335 B1 * 11/2003 Ezell ..... E21B 23/04 166/387
10,012,046 B2 * 7/2018 Ewing ..... E21B 23/04
2003/0034159 A1 2/2003 Weinig et al.
2003/0127222 A1 * 7/2003 Marcin ..... E21B 43/10 166/208
2008/0029275 A1 2/2008 Cisneros
2010/0252278 A1 * 10/2010 Harris ..... E21B 23/01 166/382
2011/0247832 A1 * 10/2011 Harris ..... E21B 33/04 166/382
2011/0284208 A1 * 11/2011 MacLeod ..... E21B 23/06 166/88.2
2014/0048263 A1 * 2/2014 Acosta ..... E21B 33/1295 166/285
2014/0054047 A1 * 2/2014 Zhou ..... E21B 43/106 166/382
2015/0300111 A1 * 10/2015 Ewing ..... E21B 23/04 166/382
2016/0237777 A1 * 8/2016 Curington ..... E21B 33/10
2016/0356131 A1 * 12/2016 Humphrey ..... E21B 33/10
2018/0238151 A1 * 8/2018 Burke ..... E21B 23/04
2018/0347308 A1 * 12/2018 Burke ..... E21B 33/0422
2019/0178044 A1 * 6/2019 Zakharia ..... E21B 43/108

* cited by examiner

SYSTEM AND METHOD FOR FORMING METAL-TO-METAL SEAL

CROSS-REFERENCE TO RELATED APPLICATION

The present document is based on and claims priority to U.S. Provisional Application Ser. No. 62/253,621, filed Nov. 10, 2015, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing geologic formation. After a wellbore is drilled, various forms of well completion components may be installed to enable control over and to enhance efficiency of producing fluids from the reservoir. In some applications, a liner hanger and liner are deployed downhole into the wellbore, and the liner hanger is suspended from well casing deployed in the wellbore. The liner hanger may be hydraulically actuated to secure the liner hanger with respect to the casing by applying hydraulic pressure to an actuator mounted along a liner hanger body. The pressure is contained between the actuator and the liner hanger body via elastomeric seals, but existing systems are susceptible to adverse conditions in certain high-pressure and/or high temperature environments.

SUMMARY

In general, a methodology and system facilitate actuation and use of a liner hanger in a wide variety of environments. Depending on the application, the liner hanger may be conveyed downhole within a casing located in a wellbore. The liner hanger comprises slips which may be set against the casing by applying a pressurized fluid through a port to an actuator, e.g. a cylindrical actuator, of the liner hanger. After the slips are set, the liner hanger may be actuated, e.g. mechanically actuated, to form a metal-to-metal seal which blocks further fluid flow through the port, thus isolating the port during subsequent downhole operations.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
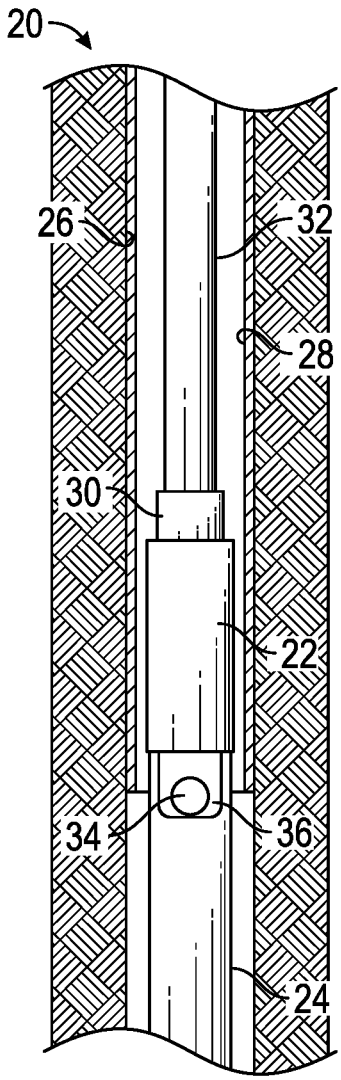
FIG. 1 is a schematic illustration of an example of a well system comprising a liner and a liner hanger deployed in a borehole, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate actuation and use of a liner hanger in a wide variety of environments. Depending on the application, the liner hanger may be conveyed downhole within a casing located in a wellbore. The liner hanger comprises slips which may be set against the casing by applying a pressurized fluid through a port(s) to an actuator piston, e.g. a cylindrical actuator, of the liner hanger. After the slips are set, the liner hanger may be further actuated, e.g. mechanically actuated, to form a metal-to-metal seal which blocks further fluid flow through the port, thus isolating the port during subsequent downhole operations. In some applications, a liner hanger body is moved through a rotational movement to crush a metallic seal in a manner which forms the metal-to-metal seal blocking fluid flow through the port.

According to an embodiment, the liner hanger has a tubular body with a port through a wall of the tubular body. A push ring is movably disposed about the tubular body and positioned for engagement with a plurality of slips and longitudinal movement of the slips. A cylindrical actuator is operatively engaged with the push ring to force longitudinal movement of the push ring when pressurized hydraulic fluid is delivered through the port from an interior of the tubular body. Continued longitudinal movement of the cylindrical actuator and push ring forces the plurality of slips against a corresponding liner hanger cone which moves the slips in a radially outward direction and into gripping engagement with the surrounding casing.

Once the liner hanger slips are set against the surrounding casing, further actuation is used to form the metal-to-metal seal which prevents further flow of actuating fluid through the port. In some embodiments, a metallic seal may be deformed by rotating the cylindrical actuator via the tubular body. For example, the cylindrical actuator may be threadably engaged with the push ring such that rotational movement of the cylindrical actuator is able to deform, e.g. crush, a metallic seal between portions of the push ring and the cylindrical actuator in a manner which isolates the port(s). By way of example, the metallic seal may be crushed against the tubular body over the port(s). In another example, the metallic seal may be crushed against the tubular body at a spaced position with respect to the port(s) when used in cooperation with a secondary metallic seal on an opposite longitudinal side of the port(s). Some embodiments of the present disclosure may use a crushed metal-to-metal seal or a crushed/wedged metal-to-metal seal in a manner which allows use of conventional hanger setting methodologies while providing a solution for high pressure, high temperature (HPHT) applications by giving a confident, permanent seal for the life of the well.

Referring generally to FIG. 1, an embodiment of a well system 20 is illustrated as utilizing a liner hanger 22 to suspend a liner 24 in a borehole 26, e.g. a wellbore. By way of example, the wellbore 26 may be cased with a casing 28 and the liner hanger 22 may be secured to the casing 28, e.g. to a lower end of the casing 28. In the illustrated embodiment, the liner 24 and liner hanger 22 are deployed downhole into borehole 26 via a liner hanger running tool 30 coupled into a running string 32, e.g. a landing string. For example, the running string 32 may be in the form of a landing string comprising drill pipe.

As described in greater detail below, actuation of the liner hanger 22 into engagement with the surrounding surface/casing 28 may be achieved by applying pressure to a hydraulic actuating fluid delivered down through an interior of the running string 32. In some applications, a ball 34 may be dropped down through running string 32 and into a corresponding ball seat 36 to form a seal and to enable pressuring up within running string 32 and liner hanger 22. The ball 34 and/or ball seat 36 may then be removed, if desired, to enable fluid flow therethrough. It should be noted that ball 34 is illustrated as representative of a variety of drop-down tools which may be used to form the desired seal and ball 34 is not limited to devices in the form of a spherical ball. For example, ball 34 may comprise a variety of spheres or semi-spherical devices, darts, plugs, or other devices shaped and constructed to form the desired seal.

Figure 2:
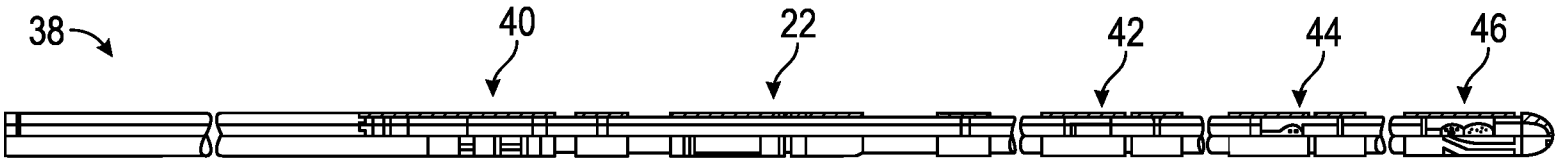
FIG. 2 is an illustration of an example of a liner hanger assembly which may be used with the well system illustrated in FIG. 1, according to an embodiment of the disclosure.
Figure 3:
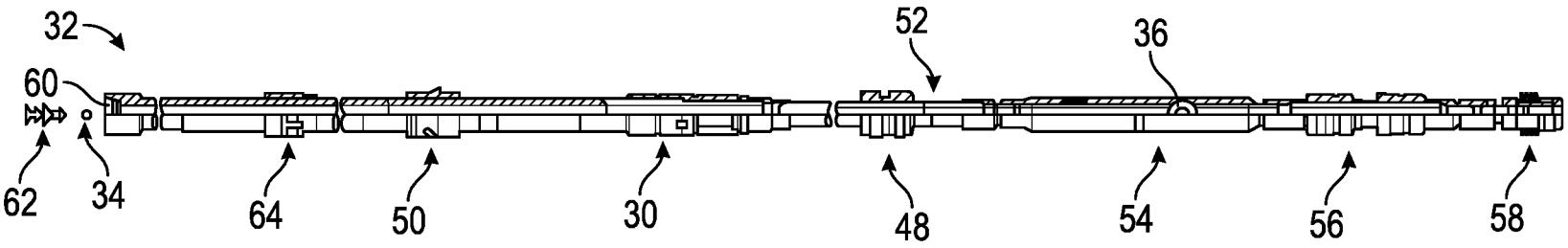
FIG. 3 is an illustration of an example of a running string assembly for deploying the liner hanger assembly, according to an embodiment of the disclosure.

Depending on the parameters of a given application, various components may be combined with liner hanger 22 and with running string 32. An example of a liner hanger system 38 incorporating liner hanger 22 is illustrated in FIG. 2. Additionally, an example of running string 32 with a variety of components is illustrated in FIG. 3. It should be noted, however, these figures provide examples and other applications may utilize additional and/or other components to provide a desired liner hanger system or running string.

Referring initially to FIG. 2, the illustrated example of liner hanger system 38 comprises liner hanger 22 positioned generally adjacent a top packer 40. The top packer 40 may be actuated to form a seal between the liner hanger system 38 and the surrounding casing 28. Examples of other components that may be combined with liner hanger 22 in system 38 include a landing collar 42, a float collar 44, and a reamer float shoe 46. However various other components may be utilized in liner hanger system 38 to facilitate a given well operation or operations.

In FIG. 3, an example of running string 32, including running tool 30, is illustrated. In this embodiment, the liner hanger running tool 30 is disposed between a retrievable cement bushing 48 and a rotating dog sub 50. The running string 32 also may comprise components such as a slick joint 52, a rotational ball seat sub 54, a swab cup assembly 56, and a liner wiper plug 58. The rotational ball seat sub 54 may comprise ball seat 36 used to receive and form a seal with ball 34. The running string 32 has an open internal passage 60 to accommodate movement of fluid and/or devices. For example, the open internal passage 60 enables the internal movement of devices such as ball 34 or a pump down plug 62. Depending on the application, the running string 32 may include a variety of other and/or additional features, such as the illustrated junk bonnet 64.

Figure 4:
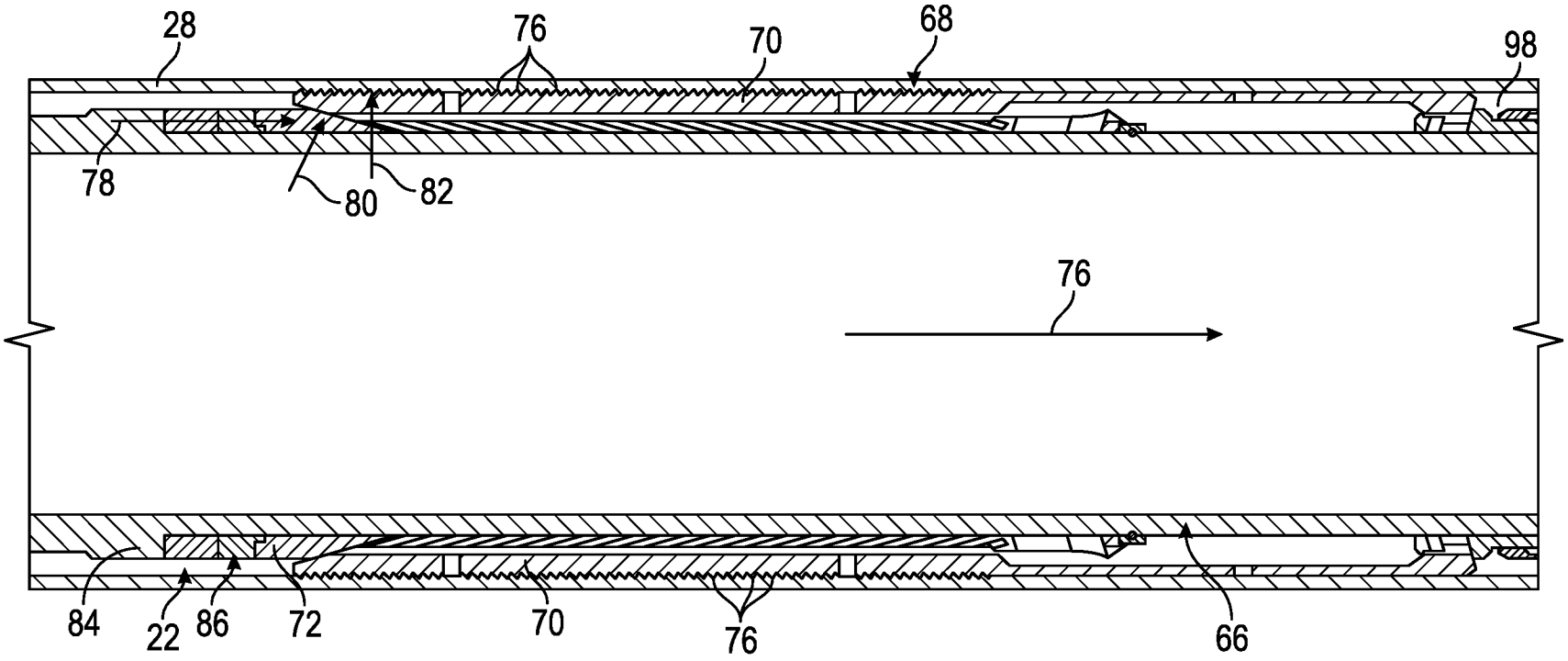
FIG. 4 is a cross-sectional illustration of part of an embodiment of a liner hanger which may be used in the well system illustrated in FIG. 1, according to an embodiment of the disclosure.

Referring generally to FIG. 4, a portion of an embodiment of liner hanger 22 is illustrated. In this example, the liner hanger 22 comprises an internal liner hanger body 66 to which is mounted a wellbore anchoring device 68 constructed to enable selective gripping of the surrounding surface, e.g. the internal surface of the surrounding casing 28. As illustrated, the wellbore anchoring device 68 is moved into engagement with wellbore casing 28 when the liner hanger 22 is set after movement of the liner hanger 22 to a desired location along borehole 26. The wellbore anchoring device 68 is actuated to secure the liner hanger 22 and liner hanger 24 against further downward travel.

According to an operational example, the running tool 30 of running string 32 is used to deploy liner hanger 22 and the overall liner hanger system 38 to the desired downhole location. The wellbore anchoring device 68 is then actuated via, for example, hydraulic pressure so as to drive a plurality of liner hanger slips 70 into engagement with the surrounding wall surface, e.g. into engagement with wellbore casing 28. As described above, ball 34 may be dropped down into sealing engagement with ball seat 36 to enable pressuring up within liner hanger 22. In the illustrated example, the liner hanger slips 70 are driven against a corresponding liner hanger cone 72 by a piston actuator 74, e.g. a cylindrical actuator disposed about liner hanger body 66 (see also FIGS. 5 and 6). As the liner hanger slips 70 are driven longitudinally by actuator 74, the liner hanger cone 72 forces gripping teeth 76 of the slips 70 radially into the surrounding casing 28. Once engaged, the wellbore anchoring device 68 resists downward movement of liner hanger 22 and liner 24.

In FIG. 4, arrow 76 represents the direction of the hanging load exerted by the liner 24 and resisted by the set liner hanger slips 70. For example, the load represented by arrow 76 may be transferred from liner hanger body 66 to the liner hanger cone 72, as represented by arrow 78. This loading is then transferred to liner hanger slips 70 through, for example, the engaged sloped surfaces as represented by load arrow 80. The load force represented by arrow 80 effectively transfers a lateral loading from the liner hanger slips 70 and into the corresponding casing 28, as represented by arrow 82. Consequently, the liner hanger 22 is able to support the weight of liner 24 suspended from liner hanger body 66 of liner hanger 22. In the example illustrated, the load 78 is transferred from liner hanger body 66 to liner hanger cone 72 via an abutment 84 formed along the external side of liner hanger body 66. In some embodiments, a bearing assembly 86, e.g. a bearing ring or rings, may be positioned between abutment 84 and liner hanger cone 72.

Figure 5:
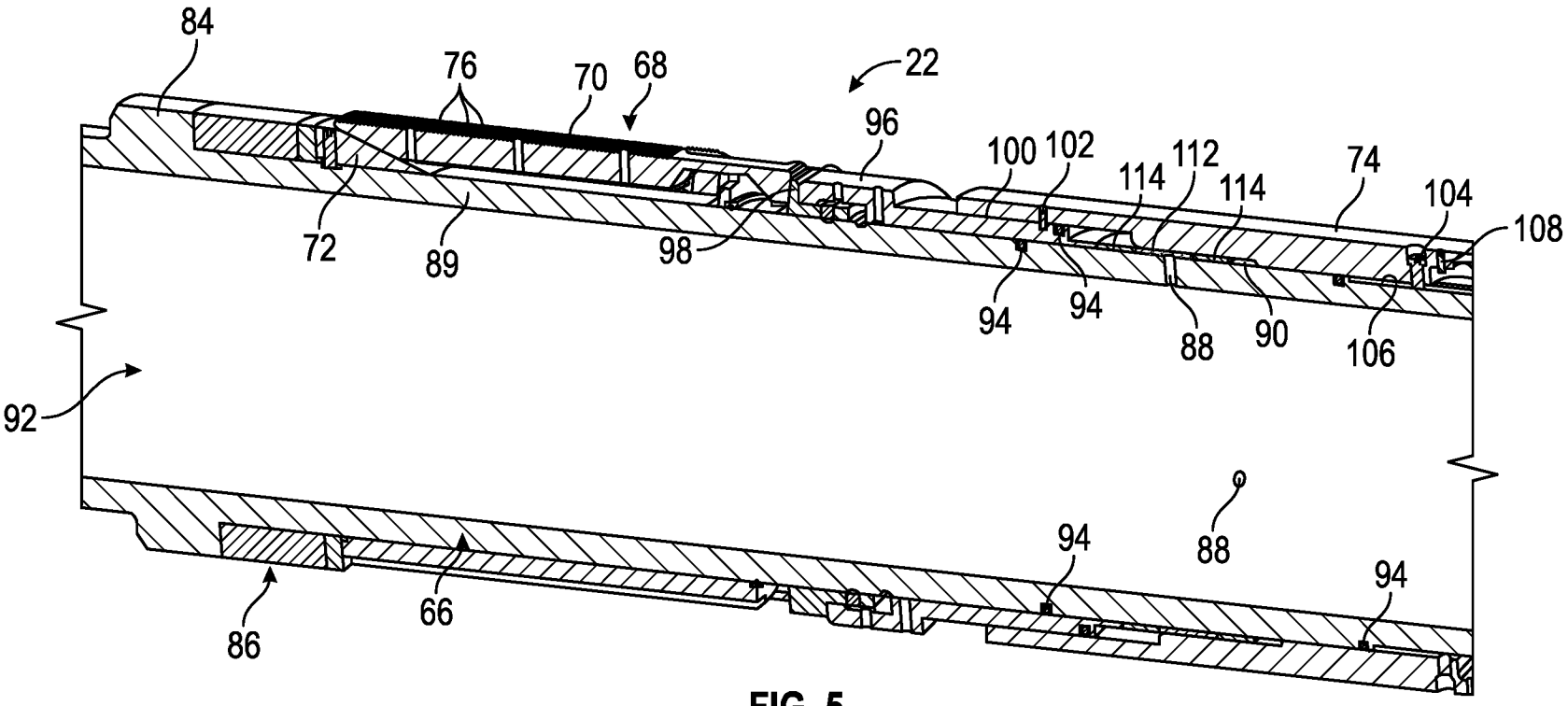
FIG. 5 is a cross-sectional illustration similar to that in FIG. 4 but showing a greater portion of the liner hanger, including an embodiment of an actuator used to actuate liner hanger slips, according to an embodiment of the disclosure.
Figure 6:
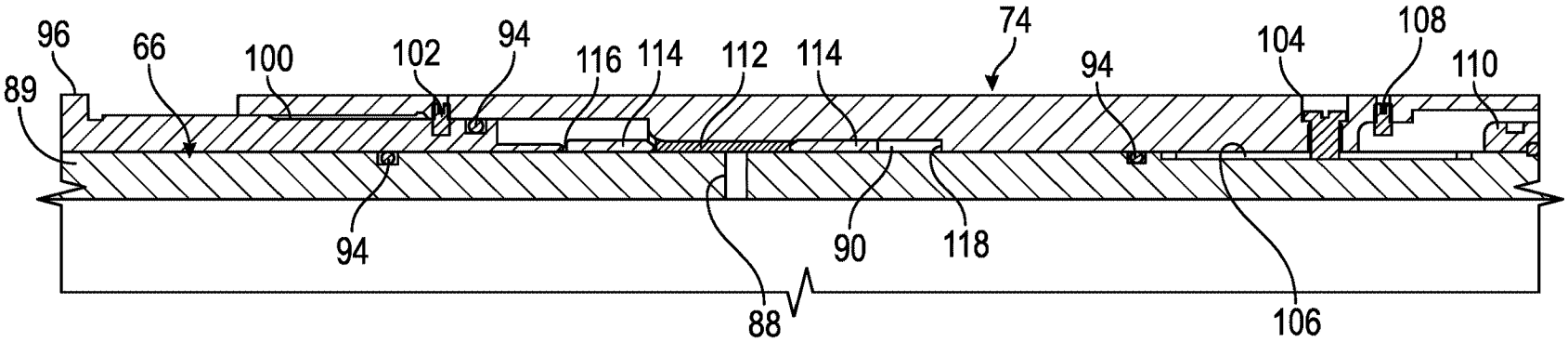
FIG. 6 is a cross-sectional illustration showing an enlarged portion of the liner hanger illustrated in FIG. 5, the enlarged portion including an example of an actuator and a metal-to-metal seal, according to an embodiment of the disclosure.

With additional reference to FIGS. 5 and 6, the illustrated embodiment shows actuator piston 74 in the form of a cylindrical actuator disposed about liner hanger body 66. The actuator piston 74 is disposed over a port 88 extending laterally through a wall 89 of the liner hanger body 66 from an interior passage 92 of the liner hanger body 66 to an exterior region between actuator piston 74 and the external surface of liner hanger body 66. In some embodiments, the port 88 comprises a plurality of ports disposed generally circumferentially along the liner hanger body 66 and positioned within cylindrical actuator 74.

The port(s) 88 extend to a sealed region 90 between liner hanger body 66 and actuator piston 74 to enable actuation of liner hanger slips 70 via application of pressurized hydraulic fluid down through internal passage 60 of the running string 32 and along interior passage 92. As described above, ball 34 may be used to enable pressuring up within liner hanger 22, e.g. within passage 92. The pressurized hydraulic fluid flows down through interior passage 92, out through ports 88, and into the sealed region 90 to force actuator piston 74 to move in a direction toward liner hanger slips 70. As described in greater detail below, the pressurized hydraulic fluid may flow into and fill sealed region 90 through a diametrical gap formed along metal-to-metal seal features. The sealed region 90 may be defined by a plurality of seals 94 which may be in the form of elastomeric seals, e.g. elastomeric O-rings or other suitable seals (see FIG. 6).

According to the embodiment illustrated, the actuator piston 74 is operatively connected to liner hanger slips 70 via a push ring 96. Additionally, a slip retainer 98 may be coupled between push ring 96 and liner hanger slips 70. The actuator piston 74 may be coupled with push ring 96 via a threaded region 100 and a shear member 102. The threaded region 100 comprises threads along push ring 96 and along actuator 74 which are threadably engaged. In this embodiment, the shear member 102 is in the form of a shear screw or other suitable shear member which rotationally locks actuator piston 74 with respect to push ring 96 during running in hole and during setting of slips 70 against casing 28.

Furthermore, the actuator piston 74 may be rotationally locked with respect to liner hanger body 66 via, for example, a key 104 extending from actuator piston 74 into a corresponding key slot 106 formed along an exterior of liner hanger body 66. The key 104 and corresponding key slot 106 allow at least a limited longitudinal movement of actuator piston 74 with respect to liner hanger body 66 while preventing relative rotational movement between the actuator piston 74 and the liner hanger body 66. Various arrangements of keys 104 or other types of interlocking elements may be used to prevent relative rotational movement while allowing the desired longitudinal movement.

It should be noted that a shear member 108 (or other suitable device) may be used to longitudinally secure actuator piston 74 on a temporary basis. In the embodiment illustrated, shear member 108 longitudinally secures actuator piston 74 to a suitable liner hanger structure 110 so as to hold the actuator piston 74 during running in hole and prior to setting of liner hanger slips 70. In FIGS. 5 and 6, the shear member 108 is illustrated as already having been sheared and moved longitudinally away from the corresponding structure 110 as a result of the actuation of cylindrical actuator 74 via pressure applied through ports 88.

Once the liner hanger slips 70 are set against the surrounding casing 28, further actuation of liner hanger 22 is used to form a metal-to-metal seal which prevents subsequent flow of actuating fluid through the ports 88. The metal-to-metal seal may be formed via a metallic seal 112 which may be appropriately deformed, e.g. crushed, to isolate port(s) 88 and to prevent further flow of fluid therethrough. As illustrated in FIG. 6, one embodiment places the metallic seal 112 longitudinally between backup rings 114, e.g. metal backup rings. The metallic seal 112 and the backup brings 114 may be sized to create a diametrical gap (prior to deformation) which allows pressurized hydraulic fluid to flow through ports 88 and into sealed region 90 to shift actuator piston 74 as described above.

By way of example, the backup rings 114 may be located between an abutment edge 116 of push ring 96 and an abutment edge 118 of cylindrical actuator 74, as illustrated. The metallic seal 112 is formed of a softer material than backup rings 114 and/or of a deformable structure which allows the metallic seal 112 to be deformed, e.g. crushed, into sealing engagement with liner hanger body 66 as the backup rings 114 are pushed closer together by abutment edges 116, 118. In some applications, the metallic seal 112 may be made of a suitable aluminum structure, steel structure, or combination of metallic materials to form the crushable or otherwise deformable seal.

In the embodiment illustrated, the metallic seal 112 is selectively deformed by rotating the cylindrical actuator 74 via the tubular hanger body 66. As described above, the cylindrical actuator 74 is engaged with push ring 96 via threaded region 100 and is rotationally fixed with respect to liner hanger body 66 via the key or keys 104. When the liner hanger body 66 is rotated, the key 104 causes cylindrical actuator 74 to shear the shear member 102 and to rotate with respect to push ring 96 along threads of threaded region 100.

Figure 7:
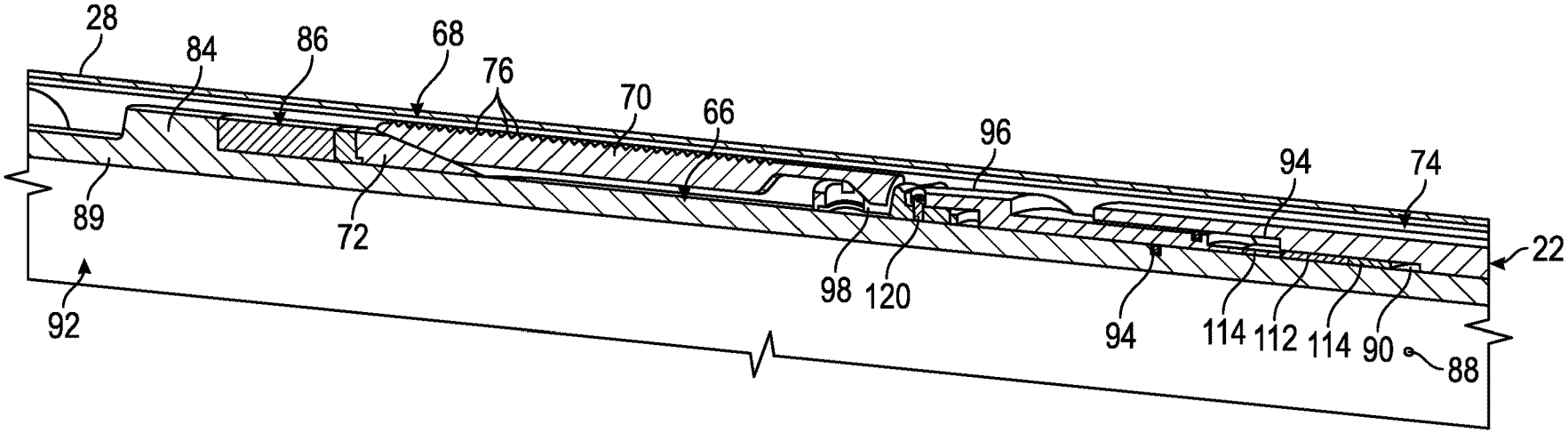
FIG. 7 is a cross-sectional illustration of a portion of the liner hanger including an example of a metal-to-metal seal and a shear member which may be sheared following setting of the liner hanger slips, according to an embodiment of the disclosure.

Meanwhile, the liner hanger slips 70 are securely engaged with casing 28 which prevents rotation of both the slips 70 and the engaged slip retainer 98. At this stage, the push ring 96 is rotationally fixed to slip retainer 98 via a shear member 120 or other suitable device, as illustrated in FIG. 7. Consequently, the push ring 96 is held against rotation as cylindrical actuator 74 is rotated by liner hanger body 66.

Figure 8:
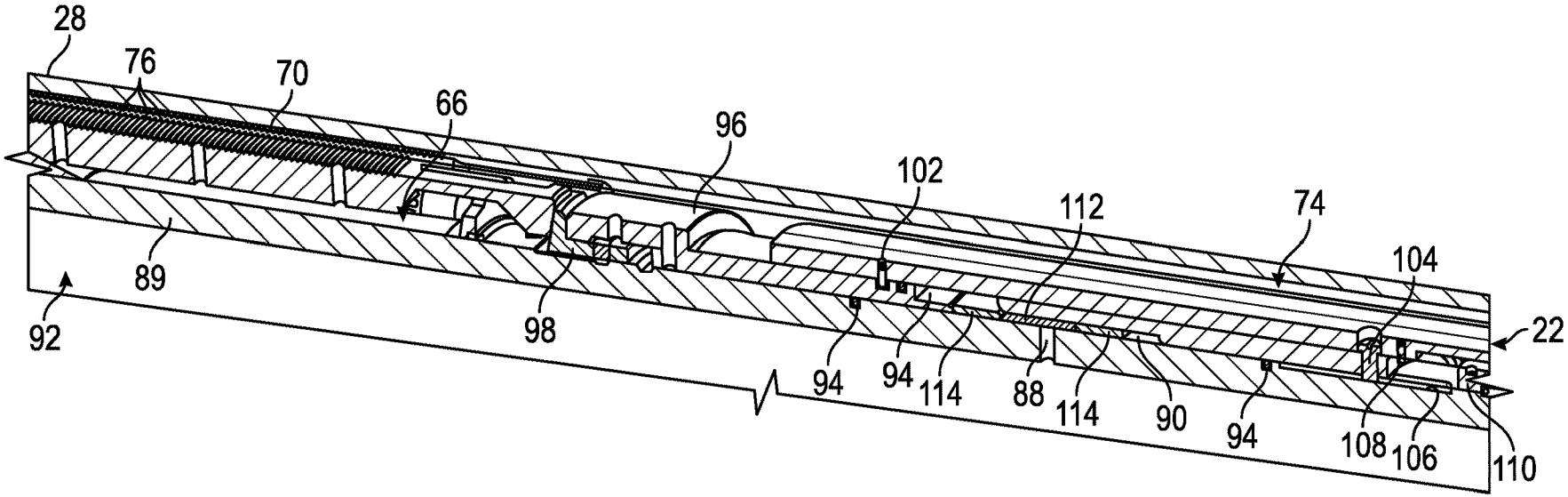
FIG. 8 is a cross-sectional illustration of a portion of the liner hanger showing an example of a push ring and a slip retainer used to actuate liner hanger slips, according to an embodiment of the disclosure.

This relative rotation on threaded region 100 causes the cylindrical actuator 74 to be drawn toward push ring 96 until backup rings 114 are engaged by abutment edges 116, 118. Continued rotation of cylindrical actuator 74 causes the backup rings 114 to continually move closer together until metallic seal 112 is crushed into sealing engagement with liner hanger body 66 over port(s) 88, thus preventing subsequent flow of fluid through ports 88. After sufficient crushing of metallic seal 112, continued rotation of cylindrical actuator 74 forces the shear member 120 to shear and to rotationally release push ring 96 from slip retainer 98, as illustrated in FIG. 8. By way of example, the axial load from the crushed metallic seal 112 may be used to provide a permanent rotational lock of the connection between push ring 96 and actuator 74 at threaded region 100, thus enabling shearing of shear member 120. At this stage, rotation of cylindrical actuator 74 also rotates push ring 96 and no additional deformation of metallic seal 112 occurs.

It should be noted, the liner hanger body 66 may be selectively rotated via running string 32. By way of example, various embodiments may use corresponding castellations on the packer body of packer 40 and running tool 30 to transmit torque from the liner hanger body 66 to the keys 104 and to the cylindrical actuator 74 while the push ring 96, slip retainer 98, slips 70, and corresponding liner hanger cone 72 are locked to the casing 28. In such embodiments, the rotational motion causes make-up of the threaded region 100 between the push ring 96 and the cylindrical actuator 74. As described above, continued rotation causes the desired deformation of metallic seal 112. After the metallic seal 112 has been deformed to form the metal-to-metal seal with liner hanger body 66, the hydraulic port 88 becomes permanently isolated. The permanent isolation provides a seal solution which does not rely on elastomeric/thermoplastic or other elements for primary or secondary backup seal protection.

Figure 9:
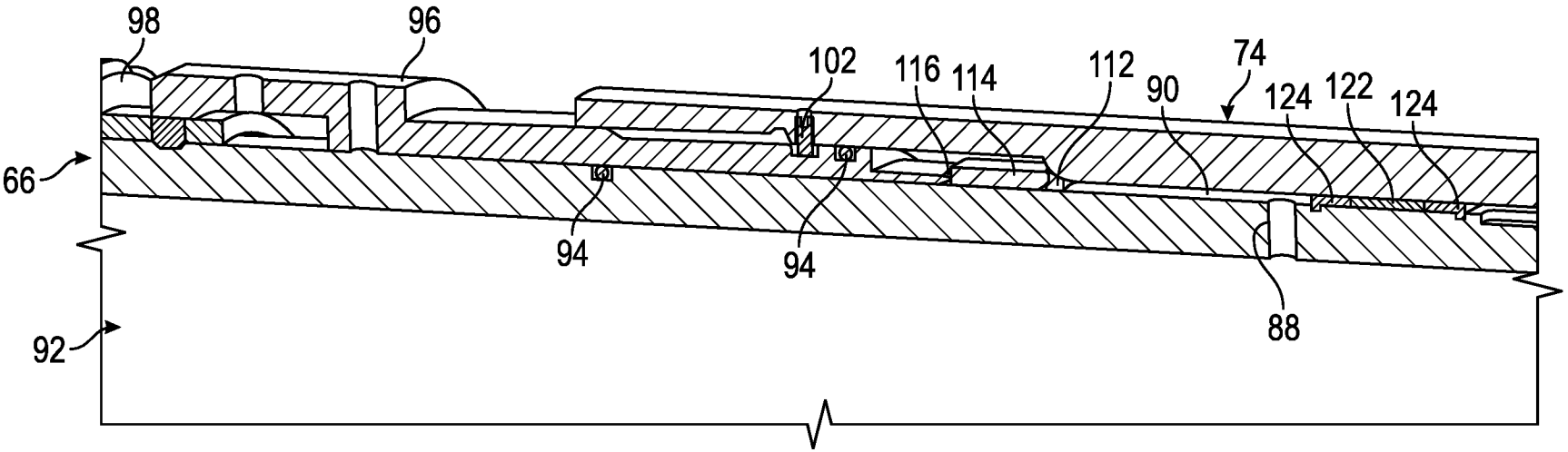
FIG. 9 is a cross-sectional illustration of a portion of another example of the liner hanger having a different embodiment of a metal-to-metal seal, according to an embodiment of the disclosure.
Figure 10:
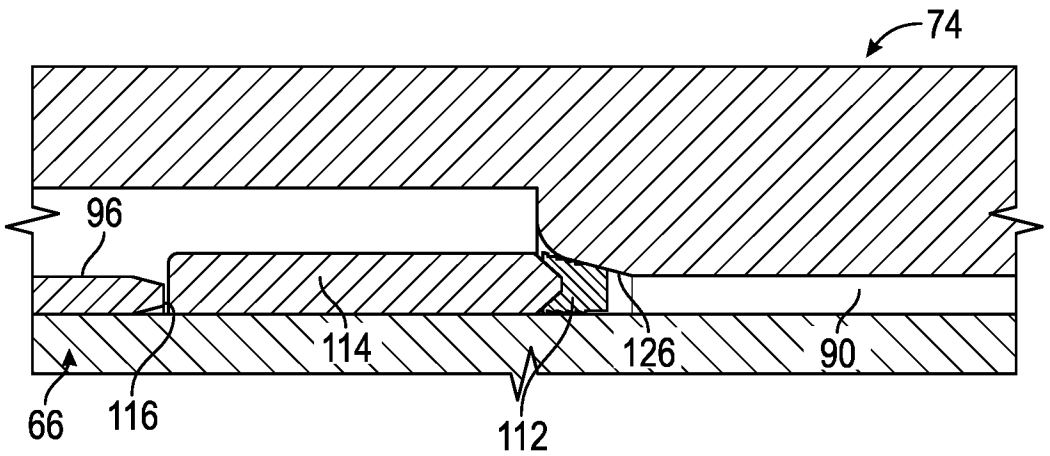
FIG. 10 is an illustration of an enlarged portion of FIG. 9 showing deformation of a metallic seal to establish the metal-to-metal seal, according to an embodiment of the disclosure.

Referring generally to FIGS. 9 and 10, another embodiment of a system and methodology for forming a metal-to-metal seal to isolate port(s) 88 is illustrated. In this embodiment, a secondary seal 122 is disposed on one longitudinal side of port 88 and the metallic seal 112 is located on the other longitudinal side of port 88. By way of example, the secondary seal 122 also may be a metallic seal held at a stationary position along liner hanger body 66 via suitable mounting features 124, e.g. retainer rings, secured to liner hanger body 66. The secondary, metallic seal 122 is thus able to form a metal-to-metal seal between liner hanger body 66 and the surrounding cylindrical actuator 74.

In this embodiment, the metallic seal 112 is disposed on an opposite side of port(s) 88 and captured between a backup ring 114 and a portion of the cylindrical actuator 74. For example, the metallic seal 112 may be captured between the backup ring 114 and a reduced diameter section 126 of cylindrical actuator 74 (see FIG. 10). The metallic seal 112 may be generally in the form of a wedge (or other suitable shape) and the reduced diameter section 126 may be angled to squeeze the metallic seal 112 against the external surface of liner hanger body 66 as the metallic seal 112 is crushed between the backup ring 114 and the sloped, reduced diameter section 126. Once the metallic seal 112 is crushed between the backup ring 114 and the cylindrical actuator 74 to form the metal-to-metal seal, further fluid flow along the exterior of liner hanger body 66 is prevented in both directions, e.g above and below port(s) 88.

As with the embodiment described with reference to FIGS. 5-8, the metallic seal 112 may be selectively deformed by rotating the cylindrical actuator 74 via the tubular hanger body 66. The cylindrical actuator 74 may again be engaged with push ring 96 via threaded region 100 and rotationally fixed with respect to liner hanger body 66 via the key or keys 104. When the liner hanger body 66 is rotated, the key 104 causes cylindrical actuator 74 to shear the shear member 102 and to rotate with respect to push ring 96 via threaded region 100. While cylindrical actuator 74 is rotated, the liner hanger slips 70 are securely engaged with casing 28 which prevents rotation of both the slips 70 and the engaged slip retainer 98. At this stage, the push ring 96 is rotationally fixed to slip retainer 98 via shear member 120 or other suitable device. Consequently, the push ring 96 is held against rotation as cylindrical actuator 74 is rotated by liner hanger body 66.

This relative rotation on threaded region 100 causes the cylindrical actuator 74 to be drawn toward push ring 96. Continued rotation of cylindrical actuator 74 causes the sloped, reduced diameter section 126 of cylindrical actuator 74 to continually move closer to the backup ring 114 until metallic seal 112 is crushed into sealing engagement with liner hanger body 66, thus preventing subsequent flow of fluid through ports 88. After sufficient crushing of metallic seal 112 (which may occur as threaded region 100 bottoms out), continued rotation of cylindrical actuator 74 forces the shear member 120 (see FIG. 7) to shear and to rotationally release push ring 96 from slip retainer 98. At this stage, rotation of cylindrical actuator 74 also rotates push ring 96 and no additional deformation of metallic seal 112 occurs.

Embodiments described herein ensure formation of metal-to-metal sealing along the liner hanger body 66 to block fluid flow through port(s) 88 after setting of liner hanger slips 70. The sealing technique may be used with various embodiments of liner hanger 22 employed in a variety of borehole applications, e.g. wellbore applications. The types of piston actuators, slips, connecting components, and other components of the liner hanger 22 may be adjusted according to the parameters of a given application.

Furthermore, the type and arrangement of metallic seals may be selected according to the parameters of a given application and environment. The metallic seal 112 may comprise individual metallic seals or combinations of metallic seals. Additionally, the metallic seal 112 may be used to isolate the port or ports 88 by deforming the metallic seal over the port(s) 88 or by working in cooperation with a secondary seal to form seal regions on both longitudinal sides of the port(s) 88. Various metals and metal alloys, e.g. steel alloys or aluminum alloys, may be used to construct the metallic seal 112. Additionally, the metallic seal 112 may have various structures, including honeycomb structures, waffle structures, tubular structures, solid structures, or other suitable structures that may be appropriately deformed to form the desired metal-to-metal seal.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for hanging tubing in a borehole, comprising:
- a liner hanger having:
- a tubular body comprising a port through a wall of the tubular body;
- a cylindrical actuator disposed around the tubular body over the port;
- a plurality of slips shiftable via movement of the cylindrical actuator upon application of sufficient pressure through the port; and
- a metallic seal crushable against at least one of the tubular body and the cylindrical actuator to form a metal-to-metal seal which isolates the port and prevents further fluid flow therethrough subsequent to shifting of the plurality of slips.

2. The system as recited in claim 1, wherein the liner hanger further comprises a push ring disposed about the tubular body between the plurality of slips and the cylindrical actuator.

3. The system as recited in claim 2, wherein rotation of the cylindrical actuator via the tubular body relative to the push ring causes the metallic seal to crush and thus form the metal-to-metal seal with the tubular body.

4. The system as recited in claim 3, wherein the cylindrical actuator and the push ring are threadably coupled to each other.

5. The system as recited in claim 3, wherein the metallic seal is crushed over the port to seal the port.

6. The system as recited in claim 3, wherein the metallic seal works in cooperation with a second metallic seal, the metallic seal and the second metallic seal being on opposite sides of the port along the tubular body.

7. The system as recited in claim 3, wherein the cylindrical actuator is rotated by the tubular body, the cylindrical actuator being rotationally locked to the tubular body by a key.

8. The system as recited in claim 7, wherein the cylindrical actuator is initially rotationally locked to the push ring by a shear member.

9. The system as recited in claim 1, wherein the port comprises a plurality of ports disposed circumferentially along the tubular body.

10. The system as recited in claim 1, further comprising a liner coupled to the liner hanger and deployed in a wellbore.

11. A system, comprising:

a liner hanger having:

a plurality of slips for setting against a casing;

a tubular body;

a port disposed in the tubular body;

a push ring disposed about the tubular body; and a cylindrical actuator disposed about the body, wherein movement of the tubular body causes the cylindrical actuator to move relative to the push ring in a manner which forms a metal-to-metal seal able to isolate the port, wherein the movement comprises rotational movement of the tubular body which, in turn, rotates the cylindrical actuator along threads disposed on the push ring so as to form a metallic seal and to thus form the metal-to-metal seal between portions of the push ring and the cylindrical actuator, which isolates the port.

12. The system as recited in claim 11, wherein the push ring is initially rotationally locked to the cylindrical actuator by a shear member.

13. The system as recited in claim 11, wherein the cylindrical actuator is rotationally locked to the tubular body by a key.

14. The system as recited in claim 11, wherein motion of the cylindrical actuator deforms the metal-to-metal seal over the port.

15. The system as recited in claim 11, where the liner hanger further comprises a seal backup ring disposed between an exterior of the tubular body and an interior of the cylindrical actuator, wherein motion of the cylindrical actuator presses a metallic seal against the seal backup ring and deforms the metallic seal, thus forming the metal-to-metal seal.

16. The system as recited in claim 11, wherein the plurality of slips is selectively set against a wellbore wall via longitudinal movement of the cylindrical actuator along the tubular member when sufficient pressure is applied to the cylindrical actuator through the port.

17. A method, comprising:

conveying a liner hanger and a liner downhole into a casing positioned in a wellbore;

setting slips of the liner hanger against the casing by applying pressurized fluid to an actuator of the liner hanger through a liner hanger port; and after setting the slips, mechanically actuating the liner hanger to form a metal-to-metal seal against at least one of the liner and the actuator, which blocks further flow of fluid through the liner hanger port, wherein mechanically actuating comprises at least one of deforming a metallic seal to form the metal-to-metal seal; and rotating the actuator in the wellbore while the slips are secured against the casing.

* * * * *